US009465320B1

(12) United States Patent
Kim

(10) Patent No.: US 9,465,320 B1
(45) Date of Patent: Oct. 11, 2016

(54) DEVELOPER SUPPLIER OPERABLE IN DEVELOPER SUPPLY PIPE AND ELECTROPHOTOGRAPHIC IMAGE FORMING APPARATUS USING THE SAME

(71) Applicant: SAMSUNG ELECTRONICS CO., LTD., Suwon-si (KR)

(72) Inventor: Yong-Sung Kim, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/924,824

(22) Filed: Oct. 28, 2015

Related U.S. Application Data

(60) Provisional application No. 62/153,216, filed on Apr. 27, 2015.

(30) Foreign Application Priority Data

Jun. 15, 2015 (KR) ..... 10-2015-0084342

(51) Int. Cl.
*G03G 15/08* (2006.01)

(52) U.S. Cl.
CPC ..... *G03G 15/0891* (2013.01)

(58) Field of Classification Search
CPC ..... G03G 15/0865; G03G 15/0879; G03G 15/0891
USPC ..... 399/258
See application file for complete search history.

(56) References Cited

U.S. PATENT DOCUMENTS

| | | | | |
|---|---|---|---|---|
| 6,968,139 | B2 * | 11/2005 | Ban et al. | G03G 15/0881 399/258 |
| 7,110,705 | B2 | 9/2006 | Harumoto | |
| 7,512,373 | B2 * | 3/2009 | Shimizu | G03G 15/0872 399/358 |
| 8,346,135 | B2 * | 1/2013 | Kikuchi et al. | G03G 15/0872 399/258 |
| 8,489,001 | B2 * | 7/2013 | Kimura | G03G 15/0879 399/258 |

* cited by examiner

*Primary Examiner* — William J Royer
(74) *Attorney, Agent, or Firm* — Staas & Halsey LLP

(57) ABSTRACT

A developer supplier for delivering a developer in a supply pipe having a multi-curvature structure is provided. The developer supplier includes a rotation shaft including a rigid first rotation shaft. The developer supplier includes a flexible second rotation shaft that has a smaller bending strength than the first rotation shaft, and is connected to the first rotation shaft, and a spiral wing formed around the rotation shaft, and at least a portion of the spiral wing formed around the second rotation shaft is flexible.

23 Claims, 11 Drawing Sheets

DEVELOPER SUPPLIER OPERABLE IN DEVELOPER SUPPLY PIPE AND ELECTROPHOTOGRAPHIC IMAGE FORMING APPARATUS USING THE SAME

CROSS-REFERENCE TO RELATED APPLICATIONS

This application is related, to and claims the benefit of priority of U.S. Provisional Application No. 62/153,216, filed on Apr. 27, 2015, in the United States Patent and Trademark Office, and Korean Patent Application No. 10-2015-0084342, filed on Jun. 15, 2015, in the Korean Intellectual Property Office, the disclosures of which are incorporated herein in their entireties by reference.

BACKGROUND

1. Field

The present disclosure relates to a developer supplier for carrying a developer to a developing device, and an electrophotographic image forming apparatus including the developer supplier.

2. Description of the Related Art

In an electrophotographic image forming apparatus, a developer is supplied to an electrostatic latent image formed on a photoconductor to develop a visible image, and the developed image is transferred and fused onto a recording medium, thereby printing an image on the recording medium.

The developing device is an assembly of components for developing images, which is attachable to and detachable from a body of the image forming apparatus. The developing device may be replaced when it is no longer usable. A developer cartridge accommodates a developer therein and supplies the developer to the developing device. The developer cartridge may be replaced independently from the developing device when the accommodated developer is fully consumed.

The developer cartridge and the developing device are connected to each other via a supply pipe. In the supply pipe, a supplier may be provided to carry the developer toward the developing device. The supply pipe may have a uniform cross-section and size and extend in a direction of gravity from the developer cartridge to the developing device. However, due to limitations of a size of the image forming apparatus, an inner component arrangement of the image forming apparatus, and the like, the supply pipe may be partially or entirely bent and thus have a multi-curvature shape. Also, a cross-sectional shape and cross-sectional area of the supply pipe may be irregular. A supplier provided in the supply pipe having such a multi-curvature structure and/or irregular cross-section structure may be bent according to the shape of the supply pipe, and a cross-sectional shape of the supplier has to match the cross-sectional shape of the supply pipe.

A flexible supplier in a supply pipe transfers the developer while rotating. However, when a developer pressure in the supply pipe abnormally increases due to a certain cause, the flexible supplier cannot rotate normally and twists. Then, a load of a driving motor that drives the supplier may increase, and thus the driving motor may stall. When the flexible supplier is further twisted, the supplier may be spirally rolled and move away from the supply pipe, and thus cause the image forming apparatus to malfunction.

SUMMARY

Provided are a developer supplier that may stably operate in a developer supply pipe having a multi-curvature structure and an electrophotographic image forming apparatus including the developer supplier.

Additional aspects will be set forth in part in the description which follows and, in part, will be apparent from the description, or may be learned by practice of the presented exemplary embodiments.

According to an aspect of an exemplary embodiment, a developer supplier for delivering a developer in a supply pipe, for example, a pipe having a multi-curvature structure, includes a rotation shaft including a first rotation shaft that is rigid, and a second rotation shaft that is flexible, has a smaller bending strength than the first rotation shaft, and is connectable to the first rotation shaft, and a spiral wing formed around the rotation shaft, at least a portion of the spiral wing formed around the second rotation shaft is flexible.

The first rotation shaft may include a rigid core, and the second rotation shaft and at least the portion of the spiral wing may be formed by insert injection molding using the rigid core as an insertion material to be flexible.

The spiral wing may include a rigid spiral wing formed around the first rotation shaft and a flexible spiral wing formed around the second rotation shaft. The first rotation shaft and the rigid spiral wing may be integrally formed by plastic molding and thus form a rigid member. The second rotation shaft and the flexible spiral wing may be formed on the rigid member by double injection molding.

The spiral wing may include a rigid spiral wing formed around the first rotation shaft and a flexible spiral wing formed around the second rotation shaft. The first rotation shaft and the rigid spiral wing may be integrally formed by insert injection molding using a metal rigid core as an insertion material and thus form a rigid member. The second rotation shaft and the flexible spiral wing may be formed on the rigid member by double injection molding.

The first rotation shaft may include a rigid core. The second rotation shaft includes a flexible core that has a smaller bending strength than the rigid core. The spiral wing may be flexible by being formed around the rigid core and the flexible core by insert injection molding.

The spiral wing may include a rigid spiral wing integrally formed around the first rotation shaft, and a flexible spiral wing integrally formed around the second rotation shaft. The first rotation shaft and the second rotation shaft may be connected to each other via a connector.

The spiral wing may include a rigid spiral wing integrally formed around the first rotation shaft, and a flexible spiral wing integrally formed around the second rotation shaft. An insertion hole may be provided in an end of the first rotation shaft, and an end of the second rotation shaft may be inserted into the insertion hole.

According to an aspect of an exemplary embodiment, an image forming apparatus includes a developer cartridge, a developing device including a photoconductor, a buffer unit between the developer cartridge and the developing device and including an inlet portion into which a developer is fed from the developer cartridge and an outlet portion, a supply pipe configured to connect the outlet portion to the developing device. In the developer supplier, the outlet portion protrudes from a side wall of the buffer unit, and the first rotation shaft extends from an inner portion of the buffer unit beyond the side wall.

A bending start location at which the supply pipe starts to bend may be spaced apart from an end of the first rotation shaft near the supply pipe by at least about 10 mm.

The first rotation shaft may extend into the supply pipe beyond the outlet portion.

The image forming apparatus may further include a driving motor configured to rotate the developer supplier. A rotation force of the driving motor may be transmitted to the first rotation shaft.

According to an aspect of an exemplary embodiment, an image forming apparatus includes a developer cartridge, a developing device including a photoconductor, a buffer unit between the developer cartridge and the developing device and including an inlet portion into which a developer is fed from the developer cartridge and an outlet portion, a supply pipe configured to connect the outlet portion to the developing device, and a developer supplier that extends into the supply pipe from the buffer unit, is configured to supply the developer from the buffer unit to the developing device, and includes a rotation shaft and a spiral wing. The outlet portion protrudes from a side wall of the buffer unit, and the developer supplier includes a rigid body extending from an inner portion of the buffer unit beyond the side wall, and a flexible body extending from the rigid body into the supply pipe and having a smaller bending strength than the rigid body.

A bending start location at which the supply pipe starts to bend may be spaced apart from an end of the rigid body near the supply pipe by at least about 10 mm.

The rigid body may extend into the supply pipe beyond the outlet portion.

The image forming apparatus may include a driving motor configured to rotate the developer supplier. A rotation force of the driving motor may be transmitted to the rigid body.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Exemplary embodiments of an electrophotographic image forming apparatus are described with reference to the drawings. As used herein, the term "and/or" includes any and all combinations of one or more of the associated listed items. Expressions such as "at least one of," when preceding a list of elements, modify the entire list of elements and do not modify the individual elements of the list.

Figure 1:
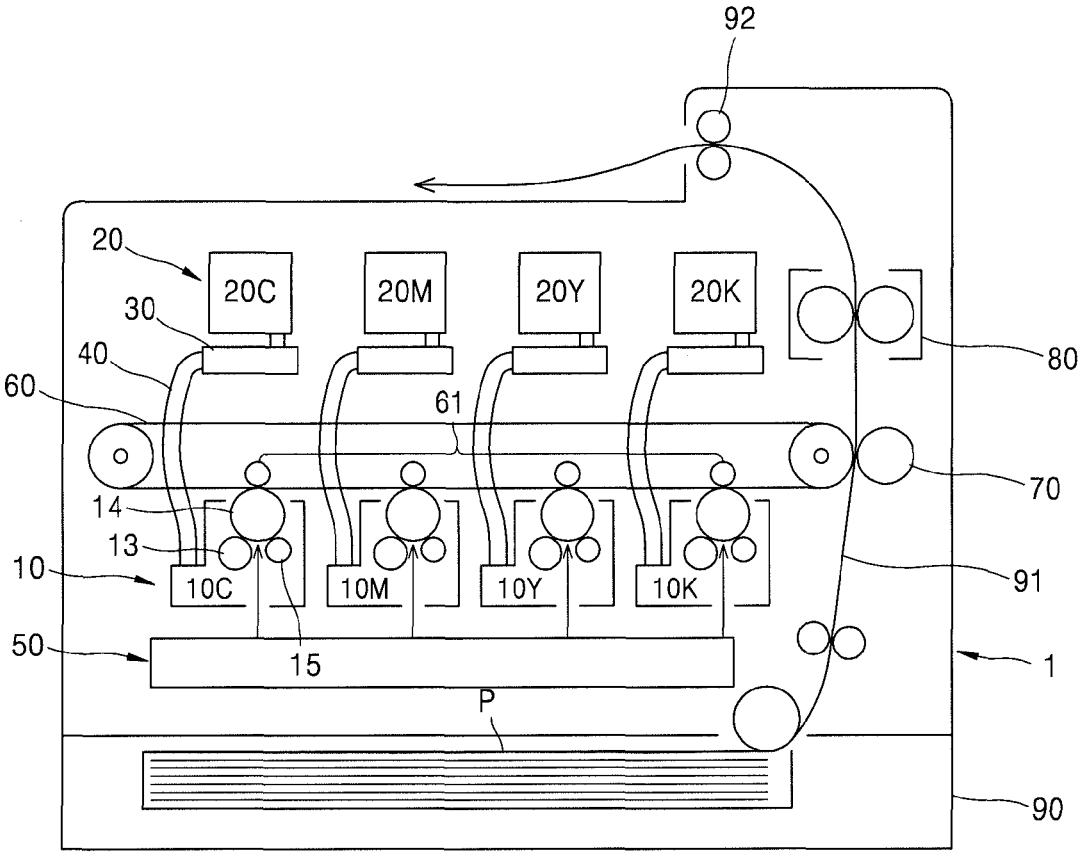
FIG. 1 is a schematic diagram of an electrophotographic image forming apparatus according to an exemplary embodiment.

FIG. 1 is a schematic diagram of an electrophotographic image forming apparatus according to an exemplary embodiment. The image forming apparatus according to an exemplary present embodiment prints a color image using electrophotography.

As illustrated in FIG. 1, the image forming apparatus 1 may include a plurality of developing devices 10 and a plurality of developer cartridges 20 that may store developers. The developer cartridges 20 may be respectively connected to the developing devices 10, and the developers in the developer cartridges 20 may be supplied to the developing devices 10. The developer cartridges 20 and the developing devices 10 may be individually replaced.

The developing device 10 may include a plurality of developing devices 10C, 10M, 10Y, and 10K for developing cyan (C), magenta (M), yellow (Y), and black (K) developers. The developer cartridge 20 may include a plurality of developer cartridges 20C, 20M, 20Y, and 20K that accommodate the cyan (C), magenta (M), yellow (Y), and black (K) developers to be supplied to the developing devices 10C, 10M, 10Y, and 10K. However, the exemplary embodiments are not limited thereto. The developer cartridge 20 and the developing device 10 may accommodate and develop developers of colors other than those above, such as light magenta, white, and the like. Hereinafter, the image forming apparatus including the developing devices 10C, 10M, 10Y, and 10K and the developer cartridges 20C, 20M, 20Y, and 20K are described. Unless specifically indicated otherwise, the individual letters C, M, Y, and K refer to components for developing cyan (C), magenta (M), yellow (Y), and black (K) developers, respectively.

The developing device 10 may include a photosensitive drum 14 on which an electrostatic latent image may be formed, and a development roller 13 that develops the electrostatic latent image into a visible toner image by using a developer supplied from the developer cartridge 20. The photosensitive drum 14 is an example of a photoconductor on which an electrostatic latent image may be formed and may include a conductive metal pipe and a photosensitive layer, for example, around an outer circumference of the conductive metal pipe. A charging roller 15 is an example of a charger that charges the photosensitive drum 14, for example, to a uniform surface potential. A charging brush, a corona charger, and the like may be used instead of the charging roller 15.

Although not illustrated, the developing device 10 may include a charge roller cleaner to remove a developer or impurities such as dust that may be attached to the charging roller 15, a cleaner to remove a developer remaining on a surface of the photosensitive drum 14 after intermediate transferring to be described below, and a regulation member to regulate an amount of a developer supplied to a development area where the photosensitive drum 14 and the development roller 13 face each other.

When a dual-component developing method is used, the developer in the developer cartridge 20 may include a toner. A carrier may be accommodated in the developing device 10. The development roller 13 may be spaced apart from the photosensitive drum 14 by a distance of an order of tens of microns to hundreds of microns. Although not illustrated, the development roller 13 may be a magnetic roller or may include a sleeve having a magnetic roller therein. The toner and the carrier may be mixed in the developing device 10, and the toner may be attached to a magnetic carrier. The magnetic carrier may be attached to a surface of the development roller 13 and transferred to the development area where the photosensitive drum 14 and the development roller 13 face each other. Due to a development bias voltage applied between the development roller 13 and the photosensitive drum 14, only the toner may be supplied to the photosensitive drum 14 so that the electrostatic latent image formed on the surface of the photosensitive drum 14 may be developed into a visible image.

When the dual-component developing method is used, the developer in the developer cartridge 20 may include a toner and a carrier. According to an exemplary embodiment, to maintain a ratio between the carrier and the toner in the developing device 10 constant, residual carrier may be discharged from the developing device 10 and accommodated, for example, in a used developer container.

When a mono-component development method that does not use a carrier is utilized, the development roller 13 may rotate while being in contact with the photosensitive drum 14. The development roller 13 may rotate at a location spaced apart from the photosensitive drum 14 by a distance in the order of tens of microns to hundreds of microns. A developer accommodated in the developer cartridge 20 may include a toner.

A development method of the image forming apparatus according to an exemplary embodiment is described above. However, the development method is not limited thereto. The development method may be modified in various ways.

An exposure unit 50 forms an electrostatic latent image on the photosensitive drum 14 by emitting light that is modulated for image information. The exposure unit 50 may include, for example, a laser scanning unit (LSU) that uses a laser diode as a light source, or a light-emitting diode (LED) exposure unit that uses LED as a light source.

An intermediate transfer belt 60 may temporarily accommodate a toner image that is developed on the photosensitive drums 14 of the developing devices 100, 10M, 10Y, and 10K. A plurality of intermediate transfer rollers 61 may be located such that they face the photosensitive drums 14 of the developing devices 10C, 10M, 10Y, and 10K, with the intermediate transfer belt 60 therebetween. An intermediate transfer bias may be applied to the intermediate transfer rollers 61 so that the image developed on the photosensitive drum 14 is intermediate-transferred to the intermediate transfer belt 60. Instead of the intermediate transfer rollers 61, a corona conveyance member or a pin scorotron type conveyance member may be used.

A transfer roller 70 may be located opposite the intermediate transfer belt 60. A transfer bias may be applied to the transfer roller 70 so that a toner image transferred to the intermediate transfer belt 60 is transferred to a recording medium P.

According to an exemplary embodiment, the image developed on the photosensitive drum 14 is intermediately transferred to the intermediate transfer belt 60, and then may be transferred to the recording medium P that passes through an area between the intermediate transfer belt 60 and the transfer roller 70. However, the exemplary embodiments are not limited thereto. Alternatively, the recording medium P may directly pass through the area between the intermediate transfer belt 60 and the photosensitive drum 14 and the developed image may directly be transferred to the recording medium P, and the, the transfer roller 70 may not be used.

A fuser 80 applies heat and/or pressure on the toner image that is transferred to the recording medium P and thus fixes the toner image onto the recording medium P. A shape of the fuser 80 is not limited to that illustrated in FIG. 1.

Due, for example, to the components described above, the exposure unit 50 may form an electrostatic latent image on the photosensitive drum 14 by scanning light, which is modulated according to image information of each color, onto the photosensitive drums 14 of the developing devices 10C, 10M, 10Y, and 10K. The electrostatic latent image on the photosensitive drums 14 of the developing devices 10C, 10M, 10Y, and 10K may be developed into a visible toner image due to the C, M, Y, and K developers that are supplied from the developer cartridges 20C, 20M, 20Y, and 20K to the developing devices 10C, 10M, 10Y, and 10K. The developed toner images may be sequentially intermediate transferred to the intermediate transfer belt 60. The recording medium P stacked on a paper feeding unit 90 may be fed along a feeding path 91 to an area between the transfer roller 70 and the intermediate transfer belt 60. Due to a transfer bias voltage applied to the transfer roller 70, the toner image that is intermediate transferred onto the intermediate transfer belt 60 may be transferred to the recording medium P. When the recording medium P passes through the fuser 80, the toner image may be fixed onto the recording medium P due to heat and pressure. When fusing is completed, the recording medium P is discharged by a discharge roller 92.

The developer in the developer cartridge 20 may be supplied to the developing device 10. When the developer in the developer cartridge 20 is fully consumed, the developer cartridge 20 may be replaced with a new developer cartridge 20, or a new developer may be charged to the developer cartridge 20. A developer residual detector to detect a remaining amount of the developer of the developer cartridge 20 may be necessary. When the developer residual detector is provided in the developer cartridge 20, once it is detected that the developer of the developer cartridge 20 is consumed to a certain level, e.g., fully consumed, printing may be possible only when the developer cartridge 20 is replaced, for example, with a new cartridge. Therefore, printing cannot be performed until a new developer cartridge 20 is provided, e.g., purchased after identifying a consumption state.

To perform printing even when the developer of the developer cartridge 20 is fully consumed or to maintain a stable supply of developer to the developing device 10, a buffer unit 30 that temporarily accommodates a developer may be provided between the developer cartridge 20 and the developing device 10. The buffer unit 30 receives a developer from the developer cartridge 20 and stores a predetermined amount of a developer, and transfers the developer to the developing device 10. A supply pipe 40 connects the buffer unit 30 to the developing device 10. A developer residual detector may be provided in the buffer unit 30. According to an exemplary embodiment since some developer may remain in the buffer unit 30 even when the developer in the developer cartridge 20 is detected as being fully consumed, printing may be performed until a replacement developer cartridge 20 is provided by using developer in the buffer unit 30.

Figure 2:
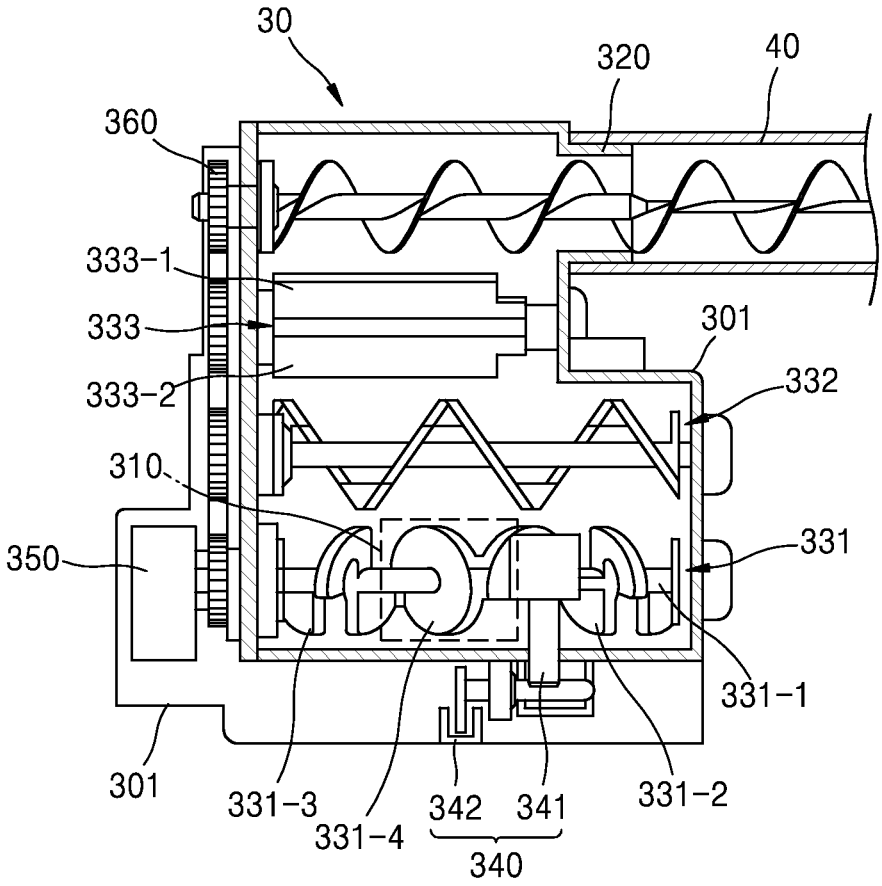
FIG. 2 is a schematic plan view of a buffer unit according to an exemplary embodiment.
Figure 3:
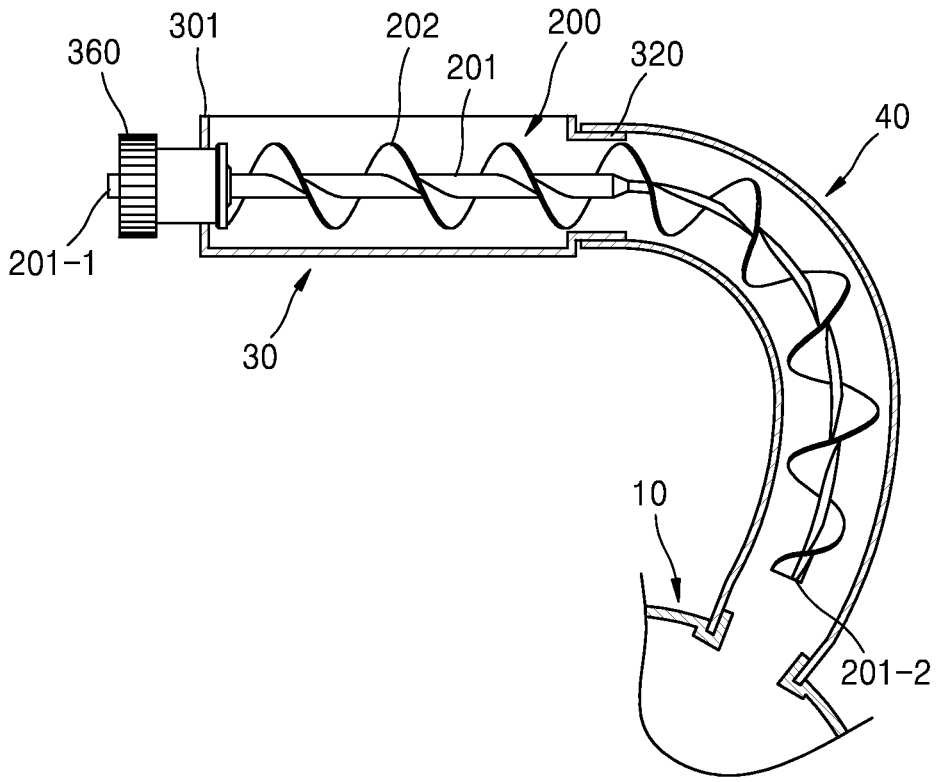
FIG. 3 is a cross-sectional view illustrating an exemplary buffer unit connected to a supply pipe.

FIG. 2 is a schematic plan view of the buffer unit 30 according to an exemplary embodiment. FIG. 3 is a cross-sectional view illustrating an exemplary buffer unit 30 connected to the supply pipe 40. As illustrated in FIGS. 2 and 3, the buffer unit 30 may include an inlet portion 310 into which a developer is fed from the developer cartridge 20, and an outlet portion 320 through which the developer is supplied to the developing device 10. The supply pipe 40 may be connected to the outlet portion 320.

The buffer unit 30 may include a conveyance member that conveys the developer that may be fed via the inlet portion 310 toward the outlet portion 320. According to an exemplary embodiment, three conveyance members 331, 332, and 333 may be provided in a direction from the inlet portion 310 to the outlet portion 320. The developer, which is fed to the buffer unit 30 from the developer cartridge 20 via the inlet portion 310, may be conveyed to the outlet portion 320 by the conveyance members 331, 332, and 333.

The conveyance member 331 may include a rotation shaft 331-1, and spiral delivery wings 331-2 and 331-3 that may deliver the developer in an axial direction. Respective spiral directions of the delivery wings 331-2 and 331-3 may be opposite one another. Therefore, when the conveyance member 331 rotates, the developer may gather in a central portion 331-4 where the delivery wings 331-2 and 331-3 are connected to each other and move toward the conveyance member 332. The conveyance member 332 may stir the developer in the buffer unit 30 so the developer will not agglomerate. The conveyance member 333 may transfer the developer in the buffer unit 30 in a radial direction. The conveyance member 333 may include a rotation shaft 333-1 and a paddle type delivery wing 333-2 that extends from the rotation shaft 333-1 in a radial direction. The number and shapes of the conveyance members are not limited to those illustrated in FIG. 2.

The supply pipe 40 may be connected to the outlet portion 320 of the buffer unit 30. For example, the outlet portion 320 may protrude from a side wall 302 (FIG. 9) of a housing 301 of the buffer unit 30. A developer supplier 200 may be provided in the buffer unit 30, may pass through the outlet portion 320, and may extend into the supply pipe 40. As illustrated in FIG. 3, the supply pipe 40 may not be straight but may have a curved, e.g., a multi-curvature structure. The supply pipe 40 may have a uniform cross-section or may not have a uniform cross-section. The developer supplier 200 that extends into the supply pipe 40 may be flexible, and thus, the developer supplier 200 may be curved, for example, according to a shape of the supply pipe 40.

The buffer unit 30 may include a driving motor 350 that drives the conveyance members 331, 332, and 333 and the developer supplier 200. The driving motor 350 may be connected to the conveyance members 331, 332, and 333 and the developer supplier 200 via a power connection unit such as gears.

The buffer unit 30 may include a developer residual detector 340. The developer residual detector 340 detects a remaining amount of the developer in the buffer unit 30. As illustrated in FIG. 2, the developer residual detector 340 may include an elevation member 341 that is movable, e.g., movable up or down according to, for example, a level of the developer in the buffer unit 30, and a sensor 342 that may sense a location of the elevation member 341.

Figure 4A:
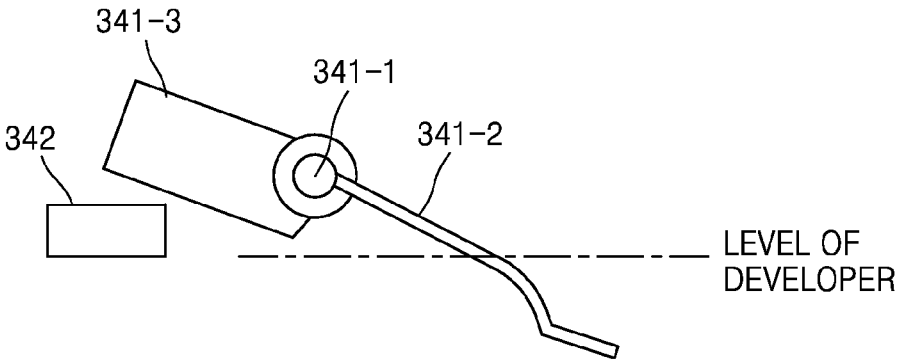
FIGS. 4A to 4C are diagrams illustrating operations of a developer residual detector according to an exemplary embodiment.
Figure 4B:
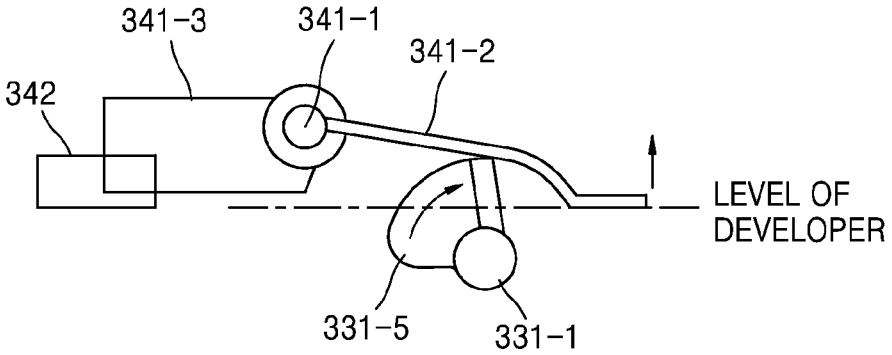
Figure 4C:
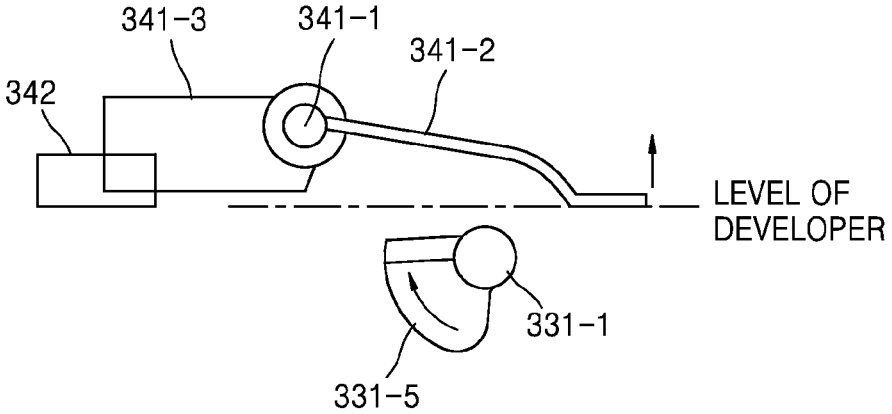

FIGS. 4A to 4C illustrate operations of the developer residual detector 340 according to an exemplary embodiment. Referring to FIG. 2 and FIGS. 4A to 4C, the elevation member 341 includes, for example, a support shaft 341-1 that may be rotatably supported in the housing 301 of the buffer unit 30, and an elevation plate 341-2 that extends from the support shaft 341-1 into the buffer unit 30 and movable up and down according to a level of the developer. The sensor 342 may directly and/or indirectly detect the elevation plate 341-2. The sensor 342 according to an exemplary embodiment detects remaining developer in the buffer unit 30 by detecting the detection plate 341-3 that is connected with the support shaft 341-1 and extends to an outer area of the buffer unit 30.

The sensor 342 may detect a location of the detection plate 341-3 by using various methods. For example, the sensor 342 may detect the location of the detection plate 341-3 by using a photosensor method based on changes in an amount of light depending on the locations of the detection plate 341-3, and a magnetic sensor method based on changes in intensity of a magnetic field depending on the locations of the detection plate 341-3. According to an exemplary embodiment, the sensor 342 detects the location of the detection plate 341-3 by using a photosensor method.

In order for a location of the elevation plate 341-2 to reflect a level of the developer, the elevation plate 341-2 may have to float above a surface of the developer of the buffer unit 30. However, when toner is accumulated on the elevation plate 341-2, the elevation plate 341-2 may be covered by the developer, and the elevation plate 341-2 maintains the covered state because the elevation plate 341-2 may not have buoyancy. In this state, the location of the elevation plate 341-2 may not reflect the level of the developer, and thus, the remaining amount of the developer cannot be accurately detected. In order to solve this problem, the elevation plate 341-2 may have to be periodically moved, e.g., raised and lowered so that the developer is not accumulated on the elevation plate 341-2.

Referring to FIGS. 4A-4C, a rotation cam 331-5 provided on the rotation shaft 331-1 of the conveyance member 331 may periodically raise and lower the elevation plate 341-2, for example, by contacting the elevation plate 341-2 as the conveyance member 331 rotates. Due to the rising and falling of the elevation plate 341-2, the developer accumulated on the elevation plate 341-2 may be removed and the elevation plate 341-2 covered by the toner may be located above the surface of the developer. The rotation cam 331-5 may be provided in the rotation shaft 331-1, separately from the delivery wings 331-2 and 331-3. Alternatively, the rotation cam 331-5 may be integrally formed on any one of the delivery wings 331-2 and 331-3.

Without the rotation cam 331-5, the elevation plate 341-2 may be covered by the toner when the level of the developer is high as illustrated in FIG. 4A. Since the sensor 342 may not detect the detection plate 341-3, the sensor 342 may generate a signal indicating that a remaining amount of the developer is low.

According to an exemplary embodiment, as the conveyance member 331 rotates, the rotation cam 331-5 may push the elevation plate 341-2 upward as illustrated in FIG. 4B. When the rotation cam 331-5 and the elevation plate 341-2 are no longer in contact, the elevation plate 341-2 may move downward. However, once the elevation plate 341-2 touches the surface of the developer, the elevation plate 341-2 does not fall further, but stops at a location that indicates the level of the developer, as illustrated in FIG. 4C. Therefore, the level of the developer may be accurately detected based on a location of the elevation plate 341-2. A controller (not illustrated) may determine whether to supply the developer from the developer cartridge 20 to the buffer unit 30 based on a detected value of the level of the developer in the buffer unit 30. For example, the controller may determine whether to drive a developer driving motor (not illustrated) in the developer cartridge 20 based on the detected value of the level of the developer in the buffer unit 30.

According to an exemplary embodiment, due to the above structure, the developer that is supplied to the buffer unit 30 via the inlet portion 310 may be delivered to the outlet portion 320 by the conveyance members 331, 332, and 333. The developer may be delivered to the developing device 10 via the supply pipe 40 by the flexible developer supplier 200. Although not illustrated, a toner concentration sensor may be provided to detect toner concentration in the developing device 10. The controller may determine whether to drive the driving motor 350 based on a detected value of the toner concentration sensor. Therefore, an adequate amount of the developer may always be in the developing device 10 and images may be printed with a uniform level of quality.

A flexible spiral coil may be used as the developer supplier 200. However, an effective sectional area of the spiral coil for delivering the developer may be determined based on a wire-diameter of the coil. In order to maintain flexibility, the wire-diameter cannot be excessively increased. Therefore, improvement of the ability of delivering the developer may be limited due to the spiral coil. To address this consideration, a flexible auger that includes a rotation shaft 201 and a spiral wing 202 may be used as the developer supplier 200.

Referring to FIGS. 2 and 3, a first end 201-1 of the rotation shaft 201 of the developer supplier 200 may be supported by the housing 301 of the buffer unit 30. For example, a gear 360 may be coupled to the first end 201-1 for power connection with the driving motor 350. A second end 201-2 may extend into the supply pipe 40. Accordingly, the developer supplier 200 may rotate in the buffer unit 30 and the supply pipe 40.

The flexible developer supplier 200 may be twisted due to, for example, a developer supply cycle via the supply pipe 40, a developer supply amount, vibration, contraction/relaxation due to external force, friction between an inner wall of the supply pipe 40 and the developer supplier 200, and/or an increase in developer pressure in the supply pipe 40. For example, since the supply pipe 40 may have a multi-curvature structure, friction between the inner wall of the supply pipe 40 and the developer supplier 200 may increase at a curved portion of the supply pipe 40, and thus, a portion of the developer supplier 200 may be unable to rotate. When a rotation force is continuously applied to the developer supplier 200 in this state, the developer supplier 200 may become twisted.

Figure 5:
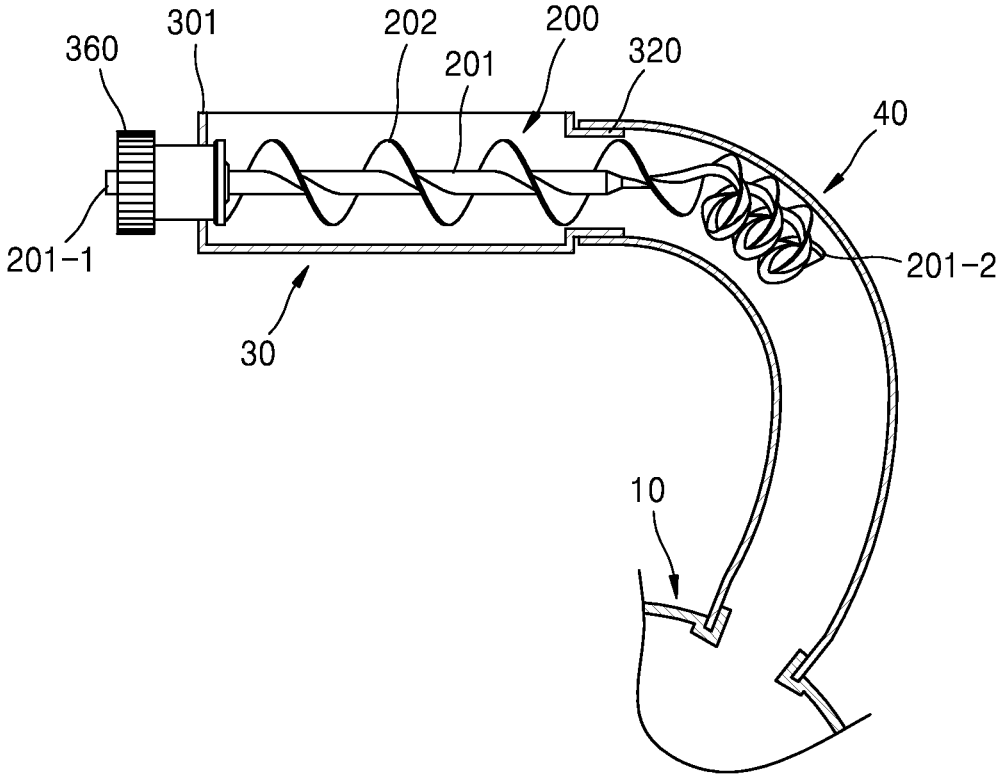
FIGS. 5 to 7 are schematic diagrams of an exemplary twisted state of a developer supplier in a supply pipe.
Figure 6:
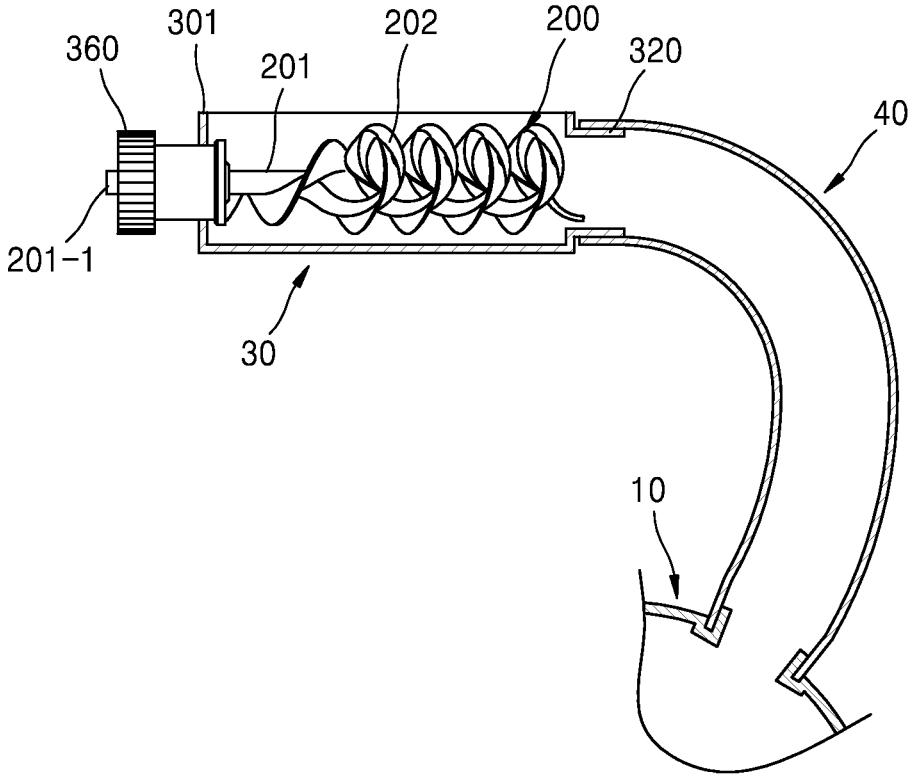
Figure 7:
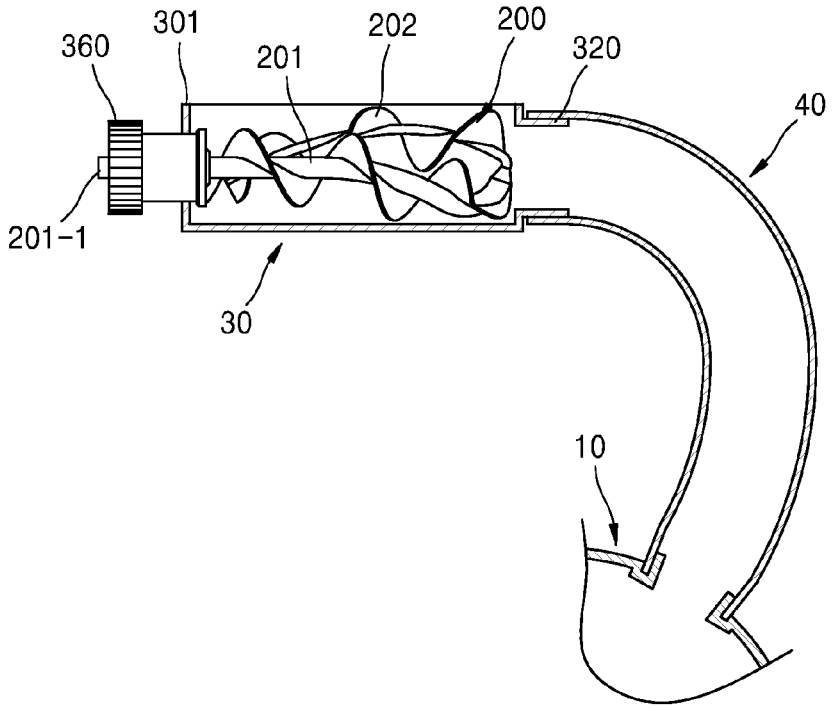

FIGS. 5 to 7 are exemplary schematic diagrams of a twisted state of the developer supplier 200 in the supply pipe 40. When the developer supplier 200 is twisted in the supply pipe 40, the second end 201-2 of the rotation shaft 201 may be forced toward the outlet portion 320. The developer supplier 200 may be twisted like a curl cord. As illustrated in FIG. 5, a twisted portion of the developer supplier 200 may still be in the supply pipe 40.

When a rotation force is further applied to the developer supplier 200 in this state, the developer supplier 200 may be twisted to its threshold, and the twisted portion in the supply pipe 40 may be untwisted within a short time. If the developer supplier 200 is formed with a flexible material overall, the developer supplier 200 may also be twisted in the buffer unit 30 and the twisted portion of the developer supplier 200 moves from the supply pipe 40 to the buffer unit 30, as illustrated in FIG. 6.

An inner space of the buffer unit 30 is larger than that of the supply pipe 40. Therefore, the twisted portion of the developer supplier 200 in the buffer unit 30 is quickly untwisted, and fills the buffer unit 30 as illustrated in FIG. 7. In this state, the developer supplier 200 may not be able to return to the supply pipe 40, and the developer may not be supplied to the developing device 10. Also, since the developer supplier 200 may not rotate, the driving motor 350 may stall and the image forming apparatus may not operate.

In order to solve this problem, the developer supplier 200 may not be twisted, for example, not twisted at least in the buffer unit 30. According to an exemplary embodiment, at least a portion of the developer supplier 200 is not twisted, a portion of the rotation shaft 201 that is located at least in the buffer unit 30 may be a rigid body.

Figure 8:
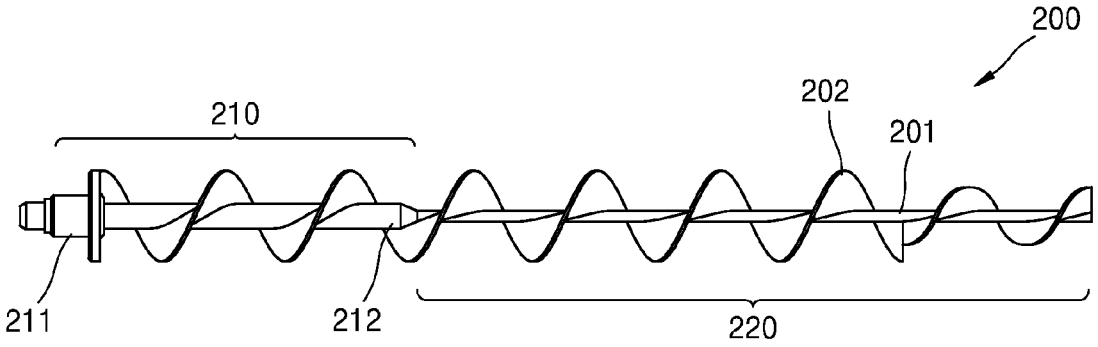
FIG. 8 is a side view of a developer supplier according to an exemplary embodiment.

FIG. 8 illustrates an exemplary embodiment of the developer supplier 200. Referring to FIG. 8, the developer supplier 200 includes a rigid body 210 and a flexible body 220. The rigid body 210 is not bent. The flexible body 220 has a smaller bending strength than the rigid body 210 and may be bent. A first end 211 of the rigid body 210 may be supported by the housing 301 of the buffer unit 30, and a second end 212 of the rigid body 210 extends toward the outlet portion 320. For example, the gear 360 may be provided at the first end 211 of the rigid body 210 to receive the rotation force of the driving motor 350. The flexible body 220 extends from the second end 212 of the rigid body 210 into the supply pipe 40. Portions of the rotation shaft 201 and the spiral wing 202 that correspond to the rigid body 210 may both be rigid bodies. Alternatively, a portion of the rotation shaft 201 that corresponds to the rigid body 210 may be a rigid body and a portion of the spiral wing 202 that corresponds to the rigid body 210 may be a flexible body. Portions of the rotation shaft 201 and the spiral wing 202 that correspond to the flexible body 220 may both be flexible bodies.

Figure 9:
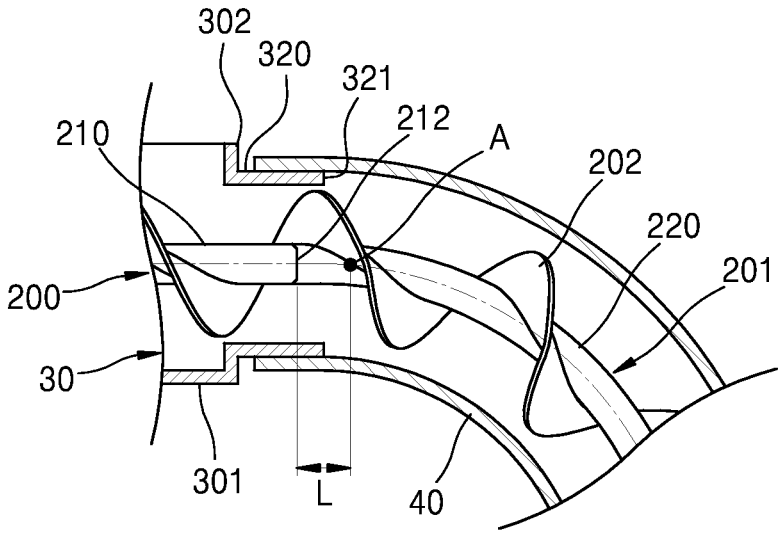
FIGS. 9 and 10 are schematic cross-sectional views illustrating exemplary locations of a rigid body, a buffer unit, and a supply pipe.
Figure 10:
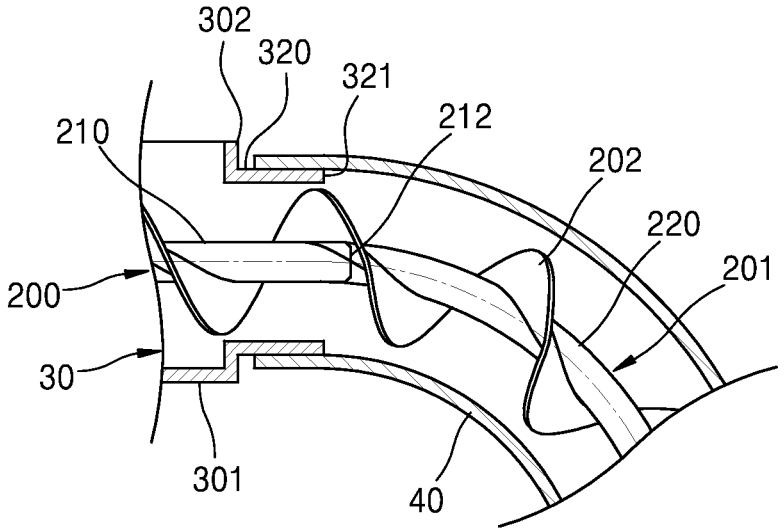

FIGS. 9 and 10 are schematic cross-sectional views illustrating locations of the rigid body 210, the buffer unit 30, and the supply pipe 40. Referring to FIG. 9, the rigid body 210 extends from an inner portion of the buffer unit 30 toward the outlet portion 320. The second end 212 of the rigid body 210, i.e., an end near the supply pipe 40, may extend beyond at least the side wall 302 of the housing 301 of the buffer unit 30 where the outlet portion 320 may be formed.

According to an exemplary embodiment, since the developer supplier 200 is not twisted at least in the buffer unit 30, the developer supplier 200 may be less twisted. Since the rotation force of the driving motor 350 may be stably transmitted to the developer supplier 200 by the rigid body 210, the developer may be stably supplied to the developing device 10 via the supply pipe 40. Even when the flexible body 220 is twisted in the supply pipe 40 as illustrated in FIG. 5, since the second end 212 of the rigid body 210 extends beyond the side wall 302 of the housing 301, the twisted portion of the flexible body 220 does not enter the inner area of the housing 301 of the buffer unit 30. Therefore, the developer supplier 200 may not be entirely twisted and fill the buffer unit 30 as illustrated in FIGS. 6 and 7. Since the flexible body 220 is twisted only in the supply pipe 40, for example, when the driving motor 350 stops, the twisted portion may naturally be untwisted by a flexible restoring force of the flexible body 220. According to an exemplary embodiment, the developer supplier 200 may rotate in a direction opposite to a direction of delivering the developer to the developing device 10 by driving the driving motor 350 in a reverse direction, and thus, the flexible body 220 may be untwisted.

According to an exemplary embodiment, the second end 212 of the rigid body 210 may extend beyond the side wall 302 of the housing 301, but not beyond an end 321 of the outlet portion 320 near the supply pipe 40. According to an exemplary embodiment as illustrated in FIG. 9, a bending start location A, where the supply pipe 40 starts to bend, may be spaced apart from the second end 212 of the rigid body 210, for example, by at least about 10 mm. That is, a distance L between the second end 212 of the rigid body 210 and the bending start location A may be, for example, at least about 10 mm.

The flexible body 220 of the developer supplier 200 may be bent after the bending start location A according to a shape of the supply pipe 40. Therefore, the flexible body 220 may be less twisted, and the rotation force of the driving motor 350 may be stably transmitted to the flexible body 220 via the rigid body 210.

As illustrated in FIG. 10, the rigid body 210 may extend into the supply pipe 40 beyond the end 321 of the outlet portion 320. The developer supplier 200 may be less twisted and more stably operate. According to an exemplary embodiment, as described with reference to FIG. 9, the distance L may be defined as a distance between the second end 212 of the rigid body 210 and the bending start location A. Thus, the flexible body 220 may be less twisted, and the rotation force of the driving motor 350 may be stably transmitted to the flexible body 220 via the rigid body 210.

The structure of the developer supplier 200 may be modified in various ways. Exemplary embodiments of the developer supplier 200 that includes the rigid body 210 and the flexible body 220 will be described with reference to FIGS. 11 to 16.

Figure 11:
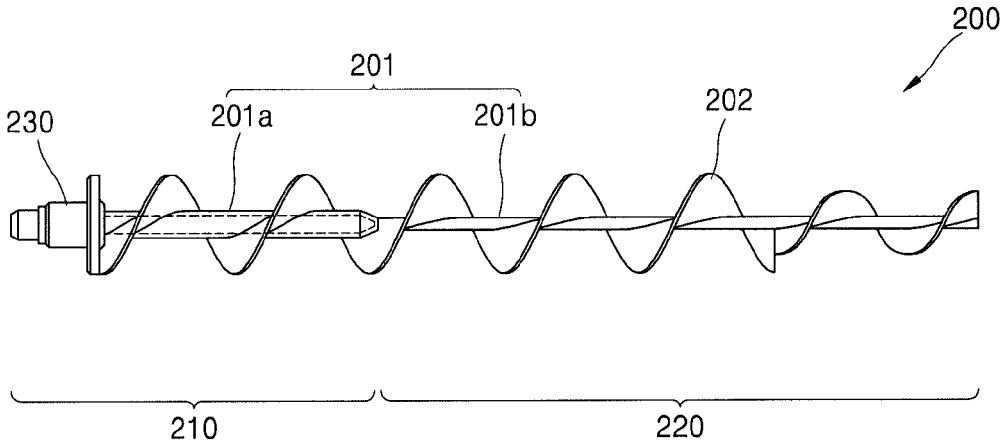
FIGS. 11 to 16 are cross-sectional views of a developer supplier including a rigid body and a flexible body, according to exemplary embodiments.

FIG. 11 is a cross-sectional view of the developer supplier 200 according to an exemplary embodiment. The developer supplier 200 according to an exemplary embodiment may be manufactured by insert injection molding. Referring to FIG. 11, a rigid core 230 is illustrated. The developer supplier 200 may be manufactured by insert injection molding including, for example, inserting the rigid core 230 into a cavity in a mold where a shape of the developer supplier 200 is engraved, and injecting a flexible material such as rubber into the cavity and thereby, forming the developer supplier 200 having the rigid core 230 as an insertion material. The rigid core 230 may include rigid materials such as metal or plastic.

According to an exemplary manufacturing method, the rigid body 210 may be formed based on the rigid core 230. That is, the rotation shaft 201 includes a first rotation shaft 201*a* that is rigid, and a second rotation shaft 201*b* that is flexible, has smaller bending strength than the first rotation shaft 201*a*, is connected with the first rotation shaft 201*a*, and extends into the supply pipe 40. The entirety of the spiral wing 202 may be a flexible body. The first rotation shaft 201*a* may be formed based on the rigid core 230.

Figure 12:
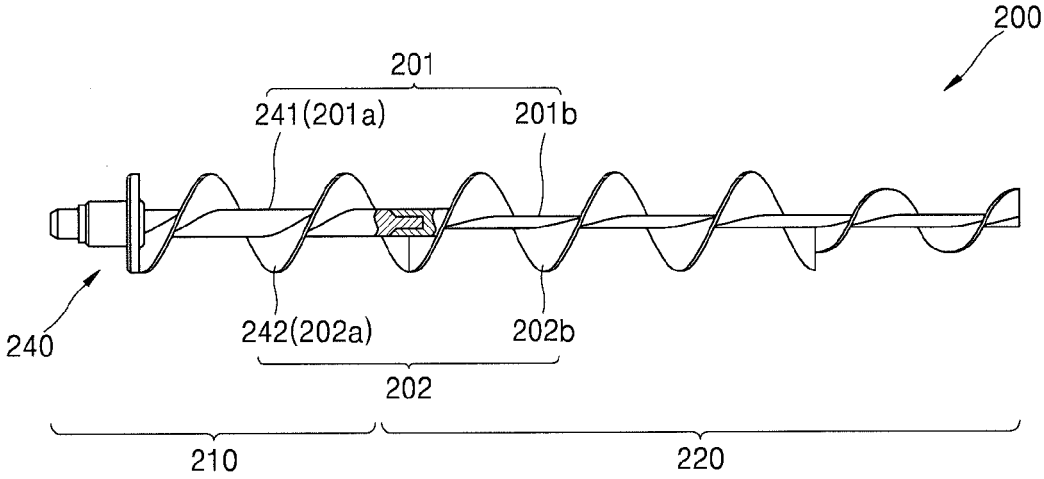

FIG. 12 is a cross-section view of the developer supplier 200 according to an exemplary embodiment. The developer supplier 200 according to an exemplary embodiment may be formed by double injection molding. Referring to FIG. 12, a rigid member 240 is illustrated. The rigid member 240 includes a rigid shaft 241 and a rigid spiral wing 242 formed around the rigid shaft 241. A mold including a first cavity with a shape of the rigid member 240 formed therein and a second cavity with a shape of the flexible body 220 engraved may be prepared. According to an embodiment, the developer supplier 200 may be manufactured by the following: first, plastic, such as ABS resin may be injected into the first cavity to form the rigid member 240, and next, a flexible material such as rubber may be injected into the second cavity to form the flexible body 220.

According to such a manufacturing method, the rigid body 210 may be formed based on the rigid member 240, the rigid first rotation shaft 201*a* may be formed based on the rigid shaft 241, and a rigid spiral wing 202*a* may be formed based on the rigid spiral wing 242. The flexible body 220 may be connected with the rigid member 240. The flexible body 220 includes the second rotation shaft 201*b* that is flexible and connected with the first rotation shaft 201*a*, i.e., the rigid shaft 241 by double injection molding, and a flexible spiral wing 202*b* formed around the second rotation shaft 201*b*. According to the developer supplier 200 illustrated in FIG. 12, the rigid body 210 and the flexible body 220 may be manufactured during a single process by double injection molding.

Figure 13:
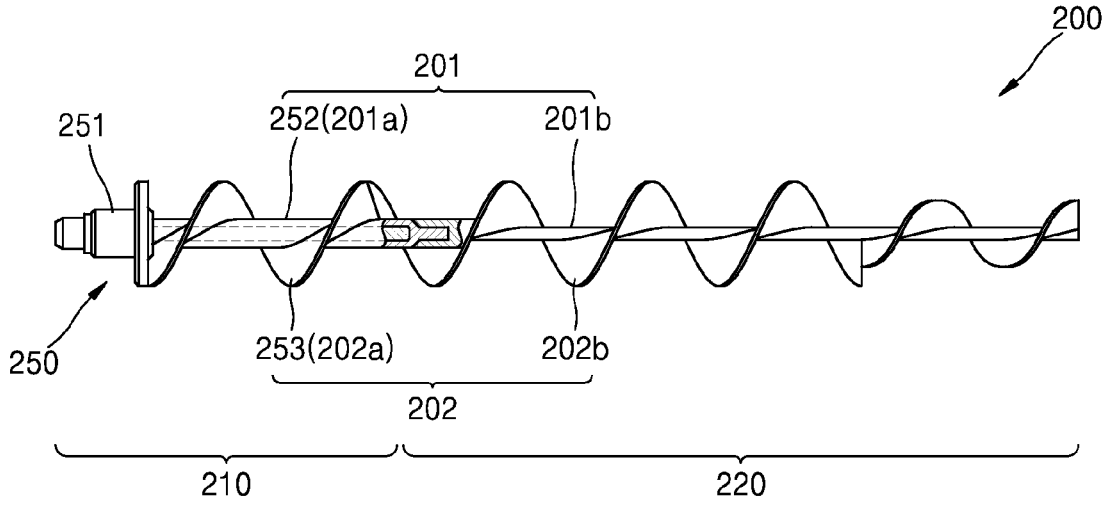

FIG. 13 is a cross-sectional view of the developer supplier 200 according to an exemplary embodiment. The developer supplier 200 according to an exemplary embodiment may be manufactured by insert injection molding and double injection molding. Referring to FIG. 13, a rigid member 250 is illustrated. The rigid member 250 may include a rigid core 251, and a covered part 252 around a periphery of the rigid core 251 and a rigid spiral wing 253. The rigid spiral wing 253 may be formed around the covered part 252. Although not illustrated, the rigid spiral wing 253 may be directly formed around the rigid core 251. The rigid core 251 may include a material that is more rigid than those of the covered part 252 and the rigid spiral wing 253. For example, the rigid core 251 may include a metal material, whereas the covered part 252 and the rigid spiral wing 253 may include a rigid plastic such as ABS resin.

A mold including a first cavity with respective shapes of the covered part 252 and the rigid spiral wing 253 formed therein and a second cavity with a shape of the flexible body 220 engraved therein may be prepared. An exemplary manufacture of the developer supplier 200 may include by inserting the rigid core 251 into the first cavity, and plastic such as ABS resin may be injected to form the rigid member 250 by insert injection molding, and then injecting a flexible material such as rubber may be injected into the second cavity. The flexible body 220 may be formed by double injection molding.

According to such an exemplary manufacturing method, the rigid body 210 may be formed based on the rigid member 250, the rigid first rotation shaft 201*a* may be formed based on the rigid core 251 and the covered part 252, and the rigid spiral wing 202*a* may be formed based on the rigid spiral wing 253. The flexible body 220 may be connected with the rigid member 250. The flexible body 220 includes the second rotation shaft 201*b* that is flexible and connected with the first rotation shaft 201*a*, for example, by double injection molding, and the flexible spiral wing 202*b* formed around the second rotation shaft 201*b*. According to the developer supplier 200 illustrated in FIG. 13, rigidity of the rigid body 210 may be improved, and the rigid body 210 and the flexible body 220 may be manufactured during a single process.

Figure 14:
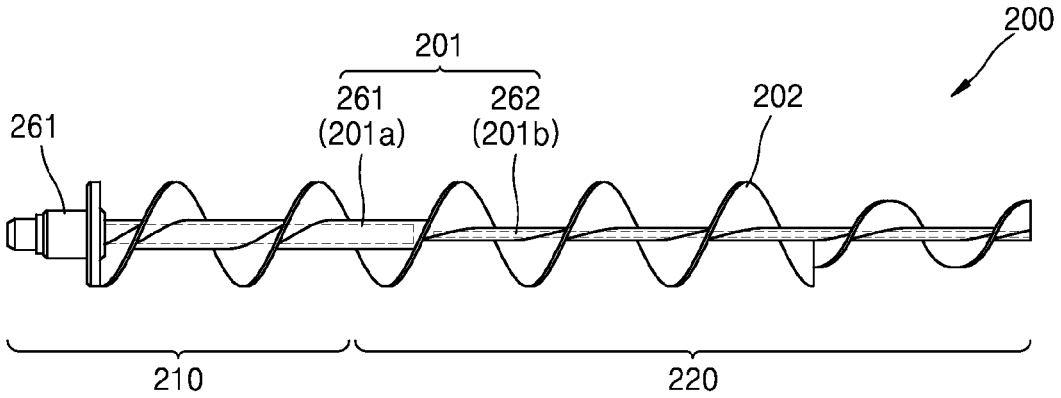

FIG. 14 is a cross-sectional view of the developer supplier 200 according to an exemplary embodiment. The developer supplier 200 according to an exemplary embodiment may be manufactured by insert injection molding. Referring to FIG. 14, a rigid core 261 and a flexible core 262 are illustrated. The developer supplier 200 may be manufactured by inserting the rigid core 261 and the flexible core 262 into a cavity in a mold where the shape of the developer supplier 200 may be engraved, and injecting a flexible material such as rubber into the cavity. The rigid core 261 may include various materials such as metal or plastic. The flexible core 262 may have a smaller bending strength than the rigid core 261. The flexible core 262 may include a bendable material, for example, thin pieces of metal or plastic.

According to an exemplary manufacturing method, the rigid body 210 may be formed based on the rigid core 261. That is, the rotation shaft 201 includes the first rotation shaft 201*a* that is formed based on the rigid core 261, and the second rotation shaft 201*b* that is flexible, formed based on the flexible core 262, and connected with the first rotation shaft 201*a* and extendable into the supply pipe 40. The entirety of the spiral wing 202 may be a flexible body. The rigid core 261 and the flexible core 262 may be a single unit. According to an embodiment, the flexible core 262 has a smaller diameter than the rigid core 261 so that the flexible core 262 may be bent and, the flexible body 220 may be less twisted.

Figure 15:
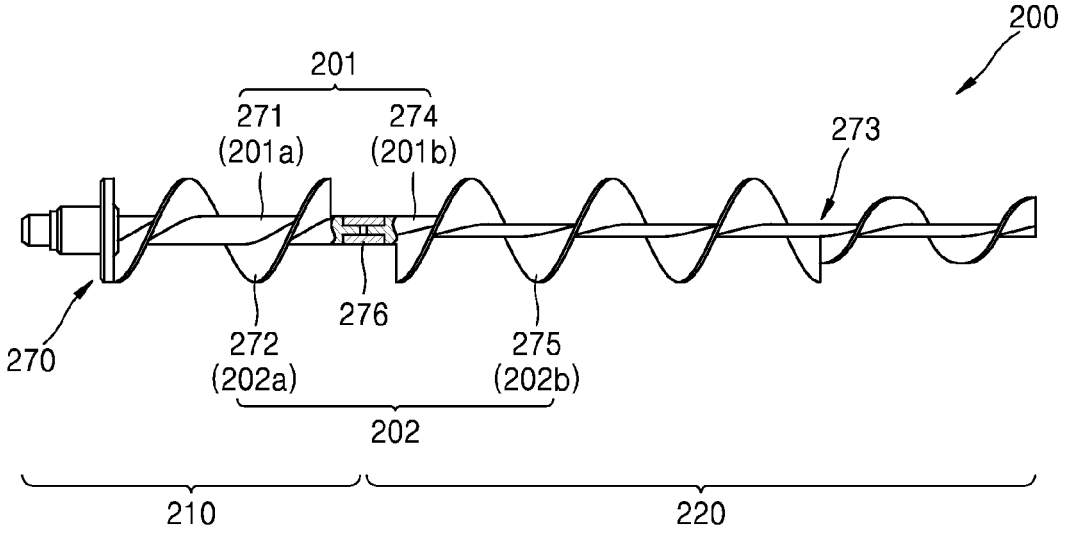

FIG. 15 illustrates a cross-sectional view of the developer supplier 200 according to an exemplary embodiment. In the developer supplier 200 according to an exemplary embodiment, the rigid body 210 and the flexible body 220 may be connected to each other by a connector 276. Referring to FIG. 15, a rigid member 270 and a flexible member 273 are illustrated. The rigid member 270 forms the rigid body 210 and the flexible member 273 forms the flexible body 220. The rigid member 270 includes a rigid rotation shaft 271 and a rigid spiral wing 272. The flexible member 273 includes a flexible rotation shaft 274 and a flexible spiral wing 275. An end of the rigid rotation shaft 271 and an end of the flexible rotation shaft 274 may be inserted into the connector 276 in a tube form by force and attached to the connector 276.

The rigid member 270 may be formed by plastic injection molding. Alternatively, the rigid member 270 may be formed by insert injection molding by using a rigid core, as in the rigid member 240 illustrated in FIG. 12.

According to such structure, the rigid body 210 may be formed based on the rigid member 270, the flexible body 220 may be formed based on the flexible member 273, the first rotation shaft 201*a* is formed based on the rigid rotation shaft 271, and the second rotation shaft 201*b* is formed based on the flexible rotation shaft 274. A rigid spiral wing 202*a* may be formed based on the rigid spiral wing 272, and a flexible spiral wing 202*b* may be formed based on the flexible spiral wing 275.

Figure 16:
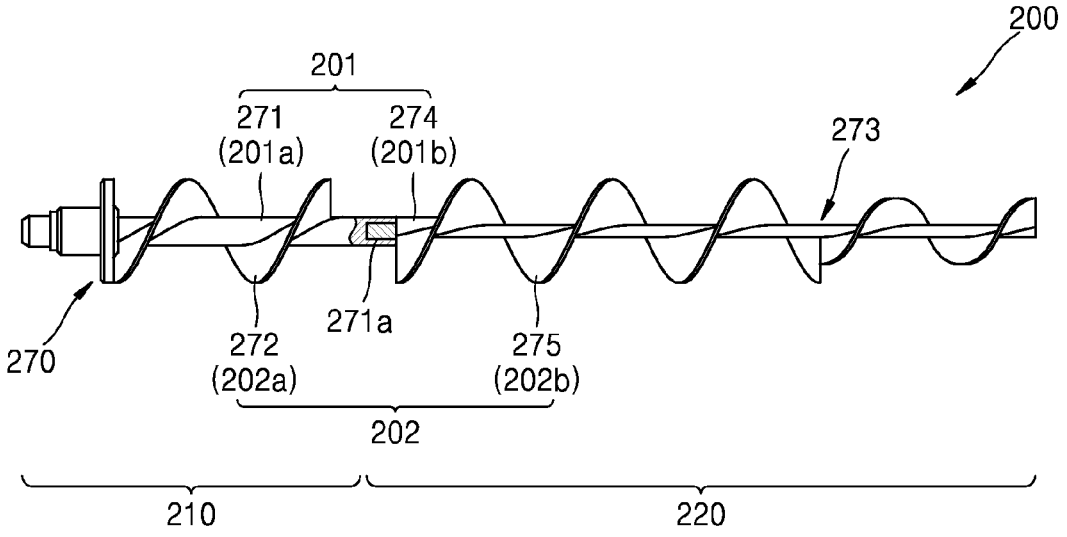

As illustrated in FIG. 16, instead of using the connector 276, an insertion hole 271*a* may be formed at an end of the rigid rotation shaft 271. An end of the flexible rotation shaft 274 may be inserted into the insertion hole 271*a*, for example, by force. The end of the flexible rotation shaft 274 may be attached to the insertion hole 271*a* while being inserted in the insertion hole 271*a*.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A developer supplier for delivering a developer in a supply pipe, the developer supplier comprising:

a rotation shaft including:

a first rotation shaft that is rigid, and a second rotation shaft that is flexible, has a smaller bending strength than the first rotation shaft, and connectable to the first rotation shaft; and a spiral wing formed around the rotation shaft, wherein at least a portion of the spiral wing formed around the second rotation shaft is flexible.

2. The developer supplier of claim 1, wherein the first rotation shaft includes a rigid core, and the second rotation shaft and the at least the portion of the spiral wing are formed by insert injection molding using the rigid core as an insertion material to be flexible.

3. The developer supplier of claim 1, wherein the spiral wing includes a rigid spiral wing formed around the first rotation shaft and a flexible spiral wing formed around the second rotation shaft, the first rotation shaft and the rigid spiral wing are integrally formed by plastic molding and form a rigid member, and the second rotation shaft and the flexible spiral wing are formed on the rigid member by double injection molding.

4. The developer supplier of claim 1, wherein the spiral wing includes a rigid spiral wing formed around the first rotation shaft and a flexible spiral wing formed around the second rotation shaft, the first rotation shaft and the rigid spiral wing are integrally formed by insert injection molding using a metal rigid core as an insertion material and forming a rigid member, and the second rotation shaft and the flexible spiral wing are formed on the rigid member by double injection molding.

5. The developer supplier of claim 1, wherein the first rotation shaft includes a rigid core, the second rotation shaft includes a flexible core that has a smaller bending strength than the rigid core, and the spiral wing is formed around the rigid core and the flexible core by insert injection molding to be flexible.

6. The developer supplier of claim 1, wherein the spiral wing includes a rigid spiral wing integrally formed around the first rotation shaft, and a flexible spiral wing integrally formed around the second rotation shaft, and the first rotation shaft and the second rotation shaft are connectable to each other via a connector.

7. The developer supplier of claim 1, wherein the spiral wing includes a rigid spiral wing integrally formed around the first rotation shaft, and a flexible spiral wing integrally formed around the second rotation shaft, and an insertion hole is provided in an end of the first rotation shaft, and an end of the second rotation shaft is inserted into the insertion hole.

8. The developer supplier of claim 1, wherein the supply pipe has a multi-curvature structure.

9. An image forming apparatus comprising:

a developer cartridge;

a developing device including a photoconductor;

a buffer unit between the developer cartridge and the developing device and including an inlet portion into which a developer is fed from the developer cartridge, and an outlet portion;

a supply pipe configured to connect the outlet portion to the developing device; and developer supplier for delivering a developer in a supply pipe, the developer supplier including:

a rotation shaft including:

a first rotation shaft that is rigid, and a second rotation shaft that is flexible, has a smaller bending strength than the first rotation shaft, and connectable to the first rotation shaft; and a spiral wing formed around the rotation shaft, wherein at least a portion of the spiral wing formed around the second rotation shaft is flexible, wherein the outlet portion protrudes from a side wall of the buffer unit, and the first rotation shaft extends from an inner portion of the buffer unit beyond the side wall.

10. The image forming apparatus of claim 9, wherein the first rotation shaft includes a rigid core, and the second rotation shaft and the spiral wing are formed by insert injection molding using the rigid core as an insertion material to be flexible.

11. The image forming apparatus of claim 9, wherein the spiral wing includes a rigid spiral wing formed around the first rotation shaft and a flexible spiral wing formed around the second rotation shaft, the first rotation shaft and the rigid spiral wing are integrally formed by plastic injection molding and form a rigid member, and the second rotation shaft and the flexible spiral wing are formed on the rigid member by double injection molding.

12. The image forming apparatus of claim 9, wherein the spiral wing includes a rigid spiral wing formed around the first rotation shaft and a flexible spiral wing formed around the second rotation shaft, the first rotation shaft and the rigid spiral wing are integrally formed by insert injection molding using a metal rigid core as an insertion material and thus form a rigid member, and the second rotation shaft and the flexible spiral wing are formed on the rigid member by double injection molding.

13. The image forming apparatus of claim 9, wherein the first rotation shaft includes a rigid core, the second rotation shaft includes a flexible core that has a smaller bending strength than the rigid core, and the spiral wing is flexible by being formed around the rigid core and the flexible core by insert injection molding.

14. The image forming apparatus of claim 9, wherein the spiral wing includes a rigid spiral wing integrally formed around the first rotation shaft, and a flexible spiral wing integrally formed around the second rotation shaft, and the first rotation shaft and the second rotation shaft are connected to each other via a connector.

15. The image forming apparatus of claim 9, wherein the spiral wing includes a rigid spiral wing integrally formed around the first rotation shaft, and a flexible spiral wing integrally formed around the second rotation shaft, and an insertion hole is provided in an end of the first rotation shaft, and an end of the second rotation shaft is inserted into the insertion hole.

16. The image forming apparatus of claim 9, wherein a bending start location at which the supply pipe starts to bend is spaced apart from an end of the first rotation shaft near the supply pipe by at least about 10 mm.

17. The image forming apparatus of claim 9, wherein the first rotation shaft extends into the supply pipe beyond the outlet portion.

18. The image forming apparatus of claim 9, further comprising a driving motor configured to rotate the developer supplier, wherein a rotation force of the driving motor is transmittable to the first rotation shaft.

19. An image forming apparatus comprising:

a developer cartridge;

a developing device comprising a photoconductor;

a buffer unit between the developer cartridge and the developing device and including:

an inlet portion into which a developer is feedable from the developer cartridge, and an outlet portion;

a supply pipe configured to connect the outlet portion to the developing device; and a developer supplier that extends into the supply pipe from the buffer unit, is configured to supply the developer from the buffer unit to the developing device, including:

a rotation shaft, and a spiral wing, wherein the outlet portion protrudes from a side wall of the buffer unit, and the developer supplier includes:

a rigid body extending from an inner portion of the buffer unit beyond the side wall, and a flexible body extending from the rigid body into the supply pipe and having a smaller bending strength than the rigid body.

20. The image forming apparatus of claim 19, wherein a bending start location at which the supply pipe starts to bend is spaced apart from an end of the rigid body near the supply pipe by at least about 10 mm.

21. The image forming apparatus of claim 9, wherein the rigid body extends into the supply pipe beyond the outlet portion.

22. The image forming apparatus of claim 19, further comprising a driving motor configured to rotate the developer supplier, wherein a rotation force of the driving motor is transmitted to the rigid body.

23. A supplier for delivering a material through a pipe, the supplier comprising:

a rotation shaft including:

a first rotation shaft that is rigid, and a second rotation shaft that is flexible, has a smaller bending strength than the first rotation shaft, and is connectable to the first rotation shaft; and a spiral wing formed around the rotation shaft, wherein at least a portion of the spiral wing formed around the second rotation shaft is flexible.

* * * * *